US007851730B2

(12) United States Patent
Carmichael et al.

(10) Patent No.: US 7,851,730 B2
(45) Date of Patent: Dec. 14, 2010

(54) APPARATUS FOR MICROWAVE COOKING OF A FOOD PRODUCT

(75) Inventors: Gary Herbert Carmichael, Des Plaines, IL (US); Corey Jacob BeVier, Chicago, IL (US); Albert Vincent Maslowski, Palatine, IL (US)

(73) Assignee: Kraft Foods Global Brands LLC, Northfield, IL (US)

( * ) Notice: Subject to any disclaimer, the term of this patent is extended or adjusted under 35 U.S.C. 154(b) by 0 days.

(21) Appl. No.: 11/537,929

(22) Filed: Oct. 2, 2006

(65) Prior Publication Data

US 2008/0099474 A1 May 1, 2008

(51) Int. Cl.
*H05B 6/80* (2006.01)

(52) U.S. Cl. ..... 219/730; 219/725; 219/727; 219/729; 219/731; 219/732

(58) Field of Classification Search ..... 219/730–735, 219/762, 763; 99/DIG. 14; 426/87, 107, 426/234, 241–245, 549
See application file for complete search history.

(56) References Cited

U.S. PATENT DOCUMENTS

| | | | | |
|---|---|---|---|---|
| 2,011,383 A | | 8/1935 | Taylor | |
| 3,865,301 A | | 2/1975 | Pothier et al. | |
| 4,013,798 A | | 3/1977 | Goltsos | |
| 4,015,085 A | | 3/1977 | Woods | |
| 4,065,583 A | * | 12/1977 | Ahlgren | 426/243 |
| 4,100,302 A | | 7/1978 | Theimer et al. | |
| 4,137,333 A | | 1/1979 | Daswick | |
| 4,190,757 A | | 2/1980 | Turpin et al. | |
| 4,195,746 A | * | 4/1980 | Cottrell | 220/4.24 |
| 4,589,568 A | | 5/1986 | Ito et al. | |
| 4,705,929 A | | 11/1987 | Atkinson | |
| 4,721,622 A | | 1/1988 | Kingham et al. | |
| 4,745,249 A | | 5/1988 | Daniels | |

(Continued)

FOREIGN PATENT DOCUMENTS

| | | |
|---|---|---|
| AU | 635667 | 6/1992 |

(Continued)

OTHER PUBLICATIONS

Refrigerated / Frozen Sandwich Packaging Literature Search Results dated Jun. 6, 2006.

(Continued)

*Primary Examiner*—Tu B Hoang
*Assistant Examiner*—Vinod D Patel
(74) *Attorney, Agent, or Firm*—Fitch, Even, Tabin & Flannery

(57) ABSTRACT

A food support surface is elevated by legs or sidewalls to raise a food product above the floor of the microwave to promote even cooking of the food product. Portions of the side walls extend above the food support surface to provide food product control. The side walls are configured to permit easy access to the food product, thus facilitating removal of the food product from the support surface. A susceptor is disposed on the food support surface to provide conductive heating of the portions of the food product contacting the susceptor during microwave heating. The material and construction of the cooking apparatus provides increased rigidity and support for the food product, while also facilitating cool handling of the cooking apparatus after microwave cooking is complete.

13 Claims, 7 Drawing Sheets

U.S. PATENT DOCUMENTS

| | | | | |
|---|---|---|---|---|
| 4,794,005 | A | 12/1988 | Swiontek | |
| 4,801,774 | A | 1/1989 | Hart | |
| 4,821,884 | A | 4/1989 | Griffin et al. | |
| 4,870,233 | A * | 9/1989 | McDonald et al. | 219/730 |
| 4,871,111 | A | 10/1989 | Mode | |
| 4,916,280 | A | 4/1990 | Havette | |
| 4,974,738 | A * | 12/1990 | Kidd et al. | 220/4.24 |
| 5,045,330 | A | 9/1991 | Pawlowski | |
| 5,095,186 | A | 3/1992 | Russell et al. | |
| 5,140,119 | A | 8/1992 | Brown et al. | |
| 5,153,402 | A | 10/1992 | Quick et al. | |
| 5,252,793 | A | 10/1993 | Woods | |
| 5,253,802 | A | 10/1993 | Bernard | |
| 5,302,790 | A | 4/1994 | Turpin | |
| 5,345,069 | A | 9/1994 | Grindrod | |
| 5,352,465 | A * | 10/1994 | Gondek et al. | 426/87 |
| 5,416,304 | A | 5/1995 | De La Cruz et al. | |
| 5,416,305 | A | 5/1995 | Tambellini | |
| 5,543,606 | A * | 8/1996 | Gics | 219/730 |
| 5,552,169 | A | 9/1996 | Kannankeril et al. | |
| 5,567,455 | A | 10/1996 | Alsbrook, Sr. | |
| 5,588,587 | A | 12/1996 | Stier et al. | |
| 5,704,483 | A | 1/1998 | Groh | |
| 5,711,978 | A | 1/1998 | Breen et al. | |
| 6,048,558 | A | 4/2000 | Feldmeier et al. | |
| 6,054,698 | A | 4/2000 | Mast | |
| 6,137,099 | A | 10/2000 | Hamblin | |
| 6,150,646 | A | 11/2000 | Lai et al. | |
| 6,168,812 | B1 | 1/2001 | Paulucci | |
| 6,320,172 | B1 | 11/2001 | Watkins | |
| 6,359,272 | B1 * | 3/2002 | Sadek et al. | 219/732 |
| 6,579,549 | B1 | 6/2003 | Thrasher et al. | |
| 6,623,777 | B2 | 9/2003 | Kawase et al. | |
| 6,764,700 | B2 | 7/2004 | Lamp et al. | |
| 6,818,873 | B2 | 11/2004 | Savage et al. | |
| 6,863,179 | B2 | 3/2005 | Leykin et al. | |
| 6,892,513 | B1 | 5/2005 | Barr et al. | |
| 6,923,338 | B2 * | 8/2005 | Dees et al. | 220/793 |
| 2002/0136815 | A1 * | 9/2002 | Kawase et al. | 426/549 |
| 2003/0071036 | A1 | 4/2003 | Savage et al. | |
| 2004/0023000 | A1 | 2/2004 | Young et al. | |
| 2004/0094544 | A1 * | 5/2004 | Kim et al. | 219/731 |
| 2004/0144781 | A1 * | 7/2004 | Dees et al. | 220/4.24 |
| 2004/0265438 | A1 | 12/2004 | Lamp et al. | |
| 2005/0133500 | A1 | 6/2005 | Brooks et al. | |
| 2005/0136156 | A1 | 6/2005 | Barr et al. | |
| 2005/0244551 | A1 | 11/2005 | Roth | |
| 2005/0281921 | A1 | 12/2005 | Langston et al. | |
| 2007/0241102 | A1 | 10/2007 | Carmichael et al. | |

FOREIGN PATENT DOCUMENTS

| | | |
|---|---|---|
| EP | 0205304 | 12/1986 |
| EP | 0320294 | 6/1989 |
| EP | 0824481 | 2/1998 |
| EP | 1181868 | 2/2002 |
| EP | 1291298 | 3/2003 |
| GB | 1089627 | 11/1967 |
| JP | 9295682 | 11/1997 |
| JP | 11243845 | 9/1999 |
| WO | 99/44428 | 9/1999 |
| WO | 03/003839 | 1/2003 |
| WO | 2003093137 | 11/2003 |
| WO | 2006001812 | 1/2006 |

OTHER PUBLICATIONS

Non-published U.S. Appl. No. 11/555,104 filed Oct. 31, 2006I.
Non-published U.S. Appl. No. 11/537,923, filed Oct. 2, 2006.
Non-published U.S. Appl. No. 11/555,079, filed Oct. 31, 2006.
PR Newswire, Graphic Packaging International Launches Latest Microwave Technology to Meet Consumer 'Grab 'n Go' Convenience Requirements, Oct. 11, 2004, HighBeam Research (2 pages).

* cited by examiner

APPARATUS FOR MICROWAVE COOKING OF A FOOD PRODUCT

FIELD

This disclosure relates to an application for microwave cooking of a food product, and in particular to an apparatus for microwave cooking of a food product on an elevated food platform having a susceptor thereon.

BACKGROUND

Heretofore, considerable effort has been expended to provide food products such as frozen or refrigerated pizzas and sandwiches for preparation by a consumer, utilizing conventional gas or electric heated ovens. More recently, with the increasing popularity of microwave ovens, attention has turned to providing consumers with kits and components for preparing dough-containing products such as frozen or refrigerated pizzas and sandwiches.

As has been detailed in U.S. Pat. No. 5,416,304, microwave ovens exhibit their own unique challenges when preparing frozen food products. For example, microwave ovens exhibit substantial temperature gradients or non-uniform heating. In addition, frozen dough-containing products have been found to exhibit a nonuniform temperature response to microwave radiation throughout their volume, during a typical heating cycle. As a result, portions of the food item melt or thaw before other portions and this results in localized accelerated heating due to the preferential absorption of microwave energy by liquids being irradiated. In addition, the microwave heating of the frozen food product can typically produce moisture that can gather at the surface of the food product, thus resulting in a soggy food product.

Various specialized packages have been developed for microwave heating of a food product. However, the existing packages have several drawbacks. Many of the existing packages require multiple components that must be arranged by the consumer in a specific configuration. Such packaging requires extra packaging materials and requires the consumer to follow several steps in assembling the food product and package for microwave heating.

Further, many of the existing packages do not provide for effective cool handling of the packaged food product upon removal from the microwave. The increased temperature of the packaged food product results in an increased burn risk and can pose challenges for a consumer when handling the packaged food item and when removing the packaged food item from the microwave.

In addition, many packages lack sufficient rigidity, support and constraint for the food product both during and after cooking. A lack of rigidity and support during microwave cooking can cause the food product support surface to sag, particularly when the food product is of a substantial size, which does not allow for maximum surface area contact between the food product and the cooking surface. A lack of lateral and transverse constraint following microwave cooking can result in a food product that is unstable and easily slidable from the package.

As a result of these and other conditions, further improvements in the preparation and packaging of dough-containing food products are being sought.

SUMMARY

Figure 1:
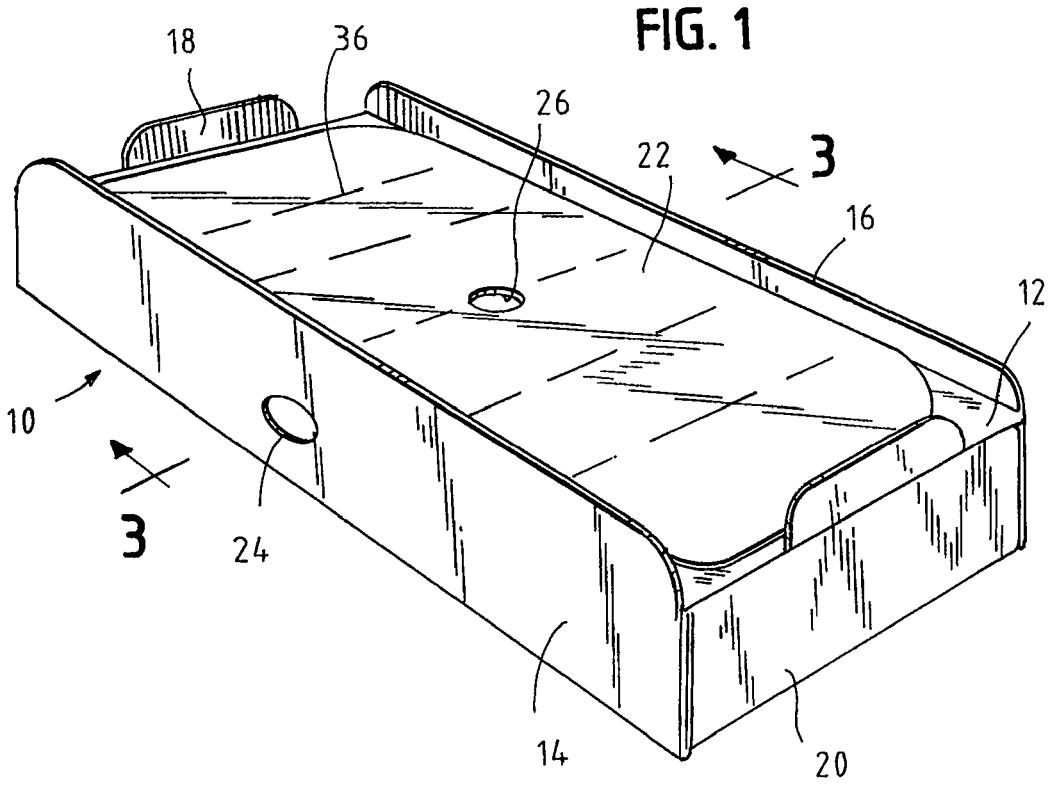
FIG. 1 is a perspective view of a first embodiment of a tray for microwave cooking of a food product.

Various embodiments of cooking apparatus for microwave cooking of a food product are disclosed. A food support surface of the cooking apparatus is elevated by legs or sidewalls to raise the food product above the floor of the microwave to promote even cooking of the food product. Portions of the side walls extend above the food support surface to provide food product control by restricting any shifting or movement of the food product while it is on the support surface. The side walls are also configured to permit easy access to the food product, thus facilitating removal of the food product from the support surface. A susceptor is disposed on the food support surface to provide conductive heating of the portions of the food product contacting the susceptor during microwave heating. The material and construction of the cooking apparatus provides increased rigidity and support for the food product, while also facilitating cool handling of the cooking apparatus after microwave cooking is complete.

In one aspect, the cooking apparatus includes an elevated food support surface with a susceptor disposed thereon. The food support surface is surrounded by a pair of opposing end constraints and a pair of opposing side walls. The end constraints and side walls control any movement of the food product and assist in retaining the food product on the support surface. The end walls may be spaced by a gap from at least one of the side walls, or a portion of the end constraint may have a height less than the height of the remaining portion of the end constraint to facilitate easy access to the food product. The food support surface includes legs depending therefrom, the legs having an inner wall and an outer wall spaced from the inner wall to facilitate cool handling of the cooking apparatus.

In another aspect, a cooking apparatus includes a tray having a bottom wall and an upstanding side wall. A food platform is disposed in the tray, the food platform having a susceptor thereon for conducting heat to the food product during microwave cooking. The food platform is spaced from the bottom wall and positioned below a top edge of the side wall, such that a food product on the food platform is constrained by a portion of the side wall. Spacing the food platform from the bottom of the tray further facilitates even cooking of the food product during microwave heating. The food platform is supported by a support integrally formed in the tray. The integral support for the food platform includes one or both of a raised portion of the bottom wall and a peripheral ledge of the side wall. The integral support provides increased rigidity for the cooking apparatus.

DETAILED DESCRIPTION

Various embodiments of a cooking apparatus in accordance with the above-discussed aspects are illustrated in FIGS. 1-13 herein. The cooking apparatus illustrated herein have a food support surface that is elevated by legs or side walls to raise the food product above the floor of a microwave during the cooking cycle to promote more even microwave cooking, particularly of the bottom of the food product. The food support surface has a susceptor disposed thereon to provide for conductive heating of the portions of the food product in contact therewith during microwave heating. In addition, side wall portions extending above the food support surface assist in controlling the food product on the surface, thus restricting shifting or movement of the food product while it is on the support surface. The side wall portions also provide spillage containment for any portion of the food product that has escaped from the food product. In addition, the side walls are configured to allow for easy access to and retrieval of the product by the consumer. The material and construction of the cooking apparatus provides a rigid structure to support the food product and also facilitates cool handling of the apparatus upon completion of the microwave cooking.

In microwave cooking, polar molecules such as water contained in the food product absorb microwave energy and release heat. Microwave energy typically penetrates further into the food than does heat generated in a conventional oven, such as radiant heat, with the result that water molecules dispersed throughout the food product are selectively heated more rapidly. Ideally, food products such as those in dough-based portions of strombolis, calzones, sandwiches, pockets, and other such food products must properly dissipate the heated moisture in order to avoid the dough-based portion becoming soggy.

The food product being prepared is preferably supported at an elevated position above the oven surface to allow a desirable portion of the moisture exiting the food product, such as if vents holes or slits are present in the food support surface, to become trapped in a determined volume so as to contribute controlled amounts of heat and moisture to the dough-based portion of the food product and to achieve a desirable brownness or crispness without becoming dried out, chewy, or hard. The food product is supported at an elevated position above the oven surface to allow cooking energy, such as microwaves, to be redirected to underneath the food product, to reach the bottom portion of the food product and achieve sufficient penetration of the food product. Thus, it can be preferable to achieve a proper ratio of moisture exiting the food product being prepared between a trapped portion used for heating of the food product and a released portion which is allowed to escape the food product to prevent its becoming soggy or chewy or otherwise undesirably moist.

Other problems associated with the use of microwave energy for the preparation of food products such as frozen or refrigerated stromboli, pockets and the like are also addressed. In general, certain instances of non-uniform heating can be associated with the preparation of food using microwave energy, such as electromagnetic radiation at a frequency of about 0.3 to 300 GHz. It can be important in order to achieve a cooked food product of pleasing appearance and texture that the dough-based portion of the food product be uniformly heated throughout the cooking. As is now generally accepted, power distribution in a microwave oven cavity can be non-uniform, giving rise to "hot spots" and "cold spots" about the environment of the food product being prepared.

Another problem in many practical applications arises from the fact that a food product, such as a frozen stromboli, typically does not exhibit desirably uniform temperature response to microwave radiation throughout its volume during a typical heating cycle. For example, a frozen stromboli when initially subjected to microwave radiation, undergoes local melting or thawing in certain portions of the stromboli, with remaining portions of the stromboli remaining frozen. This problem is accelerated in that thawed portions of a dough-based food product, such as a stromboli, pocket, or the like, will preferentially absorb greater amounts of microwave energy than the surrounding frozen portions. A further understanding of difficulties encountered in preparing dough-containing food products such as frozen pizza may be found in U.S. Pat. No. 5,416,304, the disclosure of which is herein incorporated by reference as fully set forth herein. It is important therefore that initial thawing of the food product be made as uniform as possible throughout the food product and that the energy absorption throughout the remainder of the cooking cycle remain uniform. A number of different features of the cooking apparatus disclosed herein provide improved control of microwave cooking of dough-containing food products, throughout the cooking cycle.

Figure 2:
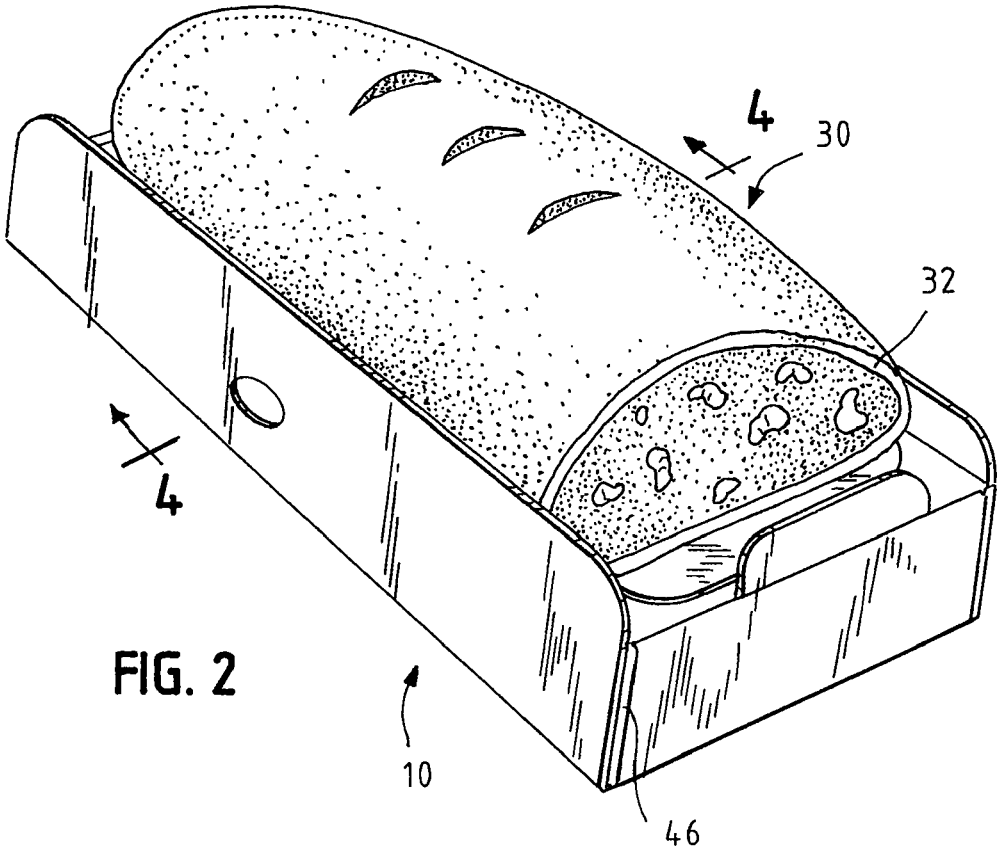
FIG. 2 is a perspective view of the tray of FIG. 1 shown in combination with a food product.

In the first embodiment illustrated in FIGS. 1-5, a cooking apparatus 10 includes a food support surface 12 having a susceptor 22 thereon. The cooking apparatus or tray 10 has legs elevating the food support surface 12. As illustrated, the food support surface 12 is generally rectangular in shape, with the legs preferably comprising a pair of longitudinal legs 14 and a pair of transverse legs 20 such that a leg depends from each side of the food support surface 12. A pair of opposing side walls 16 extends from the food support surface 12 on an opposite side of the food support surface from longitudinal legs 14. A pair of end walls 18 extends from the food support surface 12 on an opposite side of the food support surface 12 from transverse legs 20, with the end walls 18 being transverse to the side walls 16. The end walls 18 are spaced by a gap from at least one of the side walls 16, and may optionally be spaced from both side walls 16. The gap between the end wall 18 and the side wall 16 allows for easy access to a food product 30 on the food support surface 12, such as shown in FIG. 2, while still containing the food product 30 on the food support surface 12. A consumer can insert their fingers through the gaps to access the food product 30, with the gaps facilitating easy retrieval of the food product 30 from the food support surface 12. The gaps thus reduce side wall interference for a consumer trying to access and retrieve the food product 30 from the food support surface 12. Other upstanding end wall or constraint configurations are possible, such as where a portion of an end constraint has a height less than the remaining portion of the end constraint, to facilitate access to the food product.

The side walls 16 and the end walls 18 assist in controlling the product and restricting shifting or movement of the food product 30 prior to removal from the cooking apparatus 10, both before and after packaging microwave cooking.

Depending upon the height of the side walls 20 and end walls 18 and the size of the food product 30, the cooking apparatus 10 may be tilted at least 45 degrees without the food product 30 falling off of the food support surface 12. In addition, the side walls 16 and the end walls 18 can contain portions of the food product 30 that has escaped from the food product during cooking, thus providing spillage containment. For example, the side walls 16 and the end walls 18 can contain a food product, such as cheese, that has melted from between the dough portion 32 of the food product 30 and restrict such melted food product from contacting interior surfaces of a microwave. The side walls 16 and end walls 18 can also be used to pick up or lift the cooking apparatus 10.

The susceptor 22 is disposed on the food support surface 12, such that, in use, the product support surface 12 supports the food product 30 at least partially on the susceptor surface 22 at a position elevated above the bottom floor of the microwave. The legs 14, 20 support the product support surface 12 in the elevated position. The susceptor surface 22 provides for conductive heating of the portions of the food product 30 in contact therewith, such that during cooking of the food product 30 the susceptor 22 contacts the bottom of the food product 30 to provide for browning and heat conduction. The susceptor is generally sized to accommodate the food product 30 footprint, such that substantially all of the bottom surface of the food product 30 will contact the susceptors.

The food support surface 12 and the susceptor 22 may have at least one aligned vent aperture 26 formed therethrough. In addition, a series of generally aligned slits 36 may be formed in the food support surface 12 and susceptor 22. The vent 26 and the slits 36 allow steam vapor exiting the food product 30 during the cooking cycle to enter the cavity below the food support surface 12 and between the legs 14, 20. Excess amounts of steam or water vapor, beyond that desired, can exit the cavity through vents 24 in the legs 14 and other slits or openings. A defined amount of steam can be trapped beneath the food support surface 12 to provide an amount of additional heating to the food product 30, as well as maintaining moisture control of the food product environment during the cooking cycle. The illustrated embodiment shows one aligned center vent 26 and a plurality of slits 36 on the susceptor 22 and food support surface 12 and one side vent 24 on each of the longitudinal legs 14. However, other numbers and configurations of vents and/or slits may be used. Although the vent apertures are illustrated as being circular in shape, other shapes may be used.

As mentioned, the legs 14, 20 elevate the food support surface 12, and thus the food product 30, above the bottom floor of a microwave oven. Preferably, the legs 14, 20 raise the food support surface 12 an elevation sufficient to allow for microwaves to reflect off of the side walls and bottom wall of the microwave and be redirected to the underside of the food support surface 12, i.e., the side opposite the susceptor surface 22, to provide for heating of the bottom of the food product 30. For example, the legs 14, 20 may elevate the food support surface 12 between about 0.25 and 1.75 inches, and preferably about 1 inch, above the bottom wall of a microwave oven.

Figure 3:
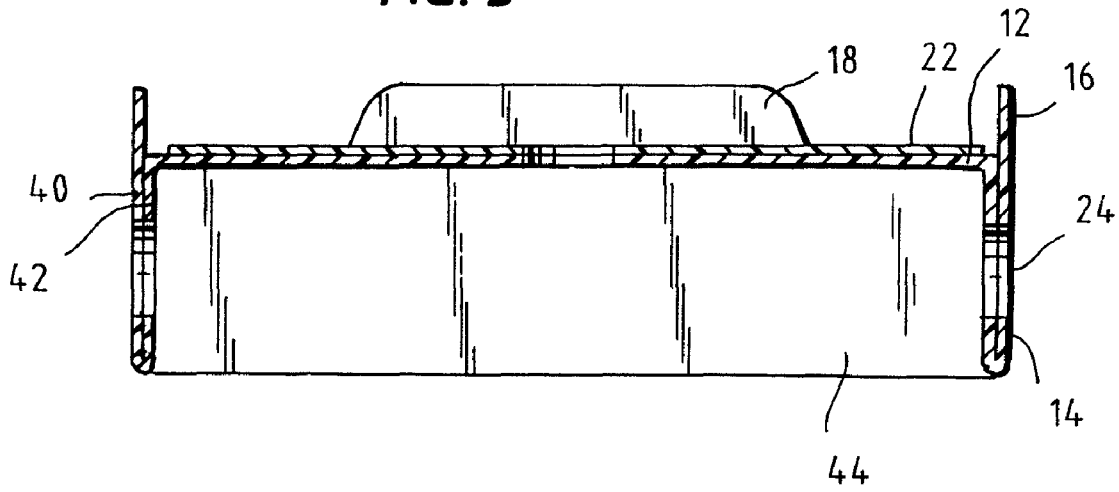
FIG. 3 is a cross-sectional elevation view of the tray of FIG. 1 taken along line III-III thereof.
Figure 4:
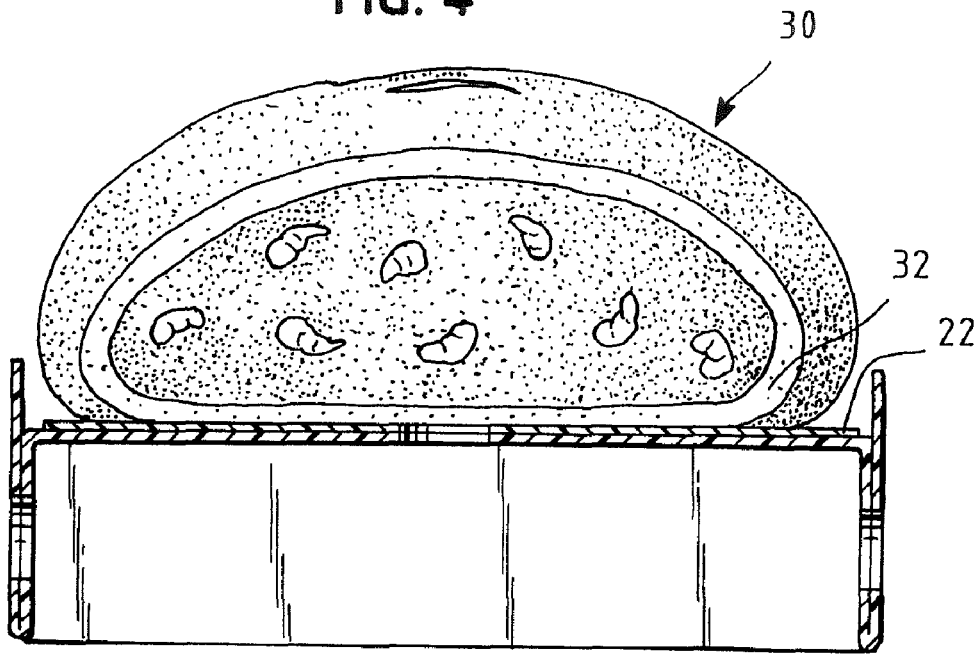
FIG. 4 is a cross-sectional elevation view of the tray and food product combination of FIG. 2 taken along line IV-IV thereof.

The food support surface 12 has a pair of parallel, opposing longitudinal legs 14 and a pair of parallel, opposing transverse legs 20 depending therefrom. As illustrated in FIG. 3, the longitudinal legs 14 have an inner wall 42 and outer wall 40 slightly spaced from the inner wall 42, such that a small air pocket is formed. A similar configuration is also optionally provided for the transverse legs 20, with each having an inner wall 44 and an outer wall 46 spaced from the inner wall 44. Such a configuration facilitates cool handling of the cooking apparatus 10 after microwave cooking by providing insulation of the legs 14, 20. Thus, a consumer is able to more safely handle the cooking apparatus 10 upon removing the apparatus from the microwave. The double thickness 14, 20 of the legs provided the inner and outer walls also provides increased rigidity and structure for the cooking apparatus 10 and increased support for the weight of the food product 30.

Figure 5:
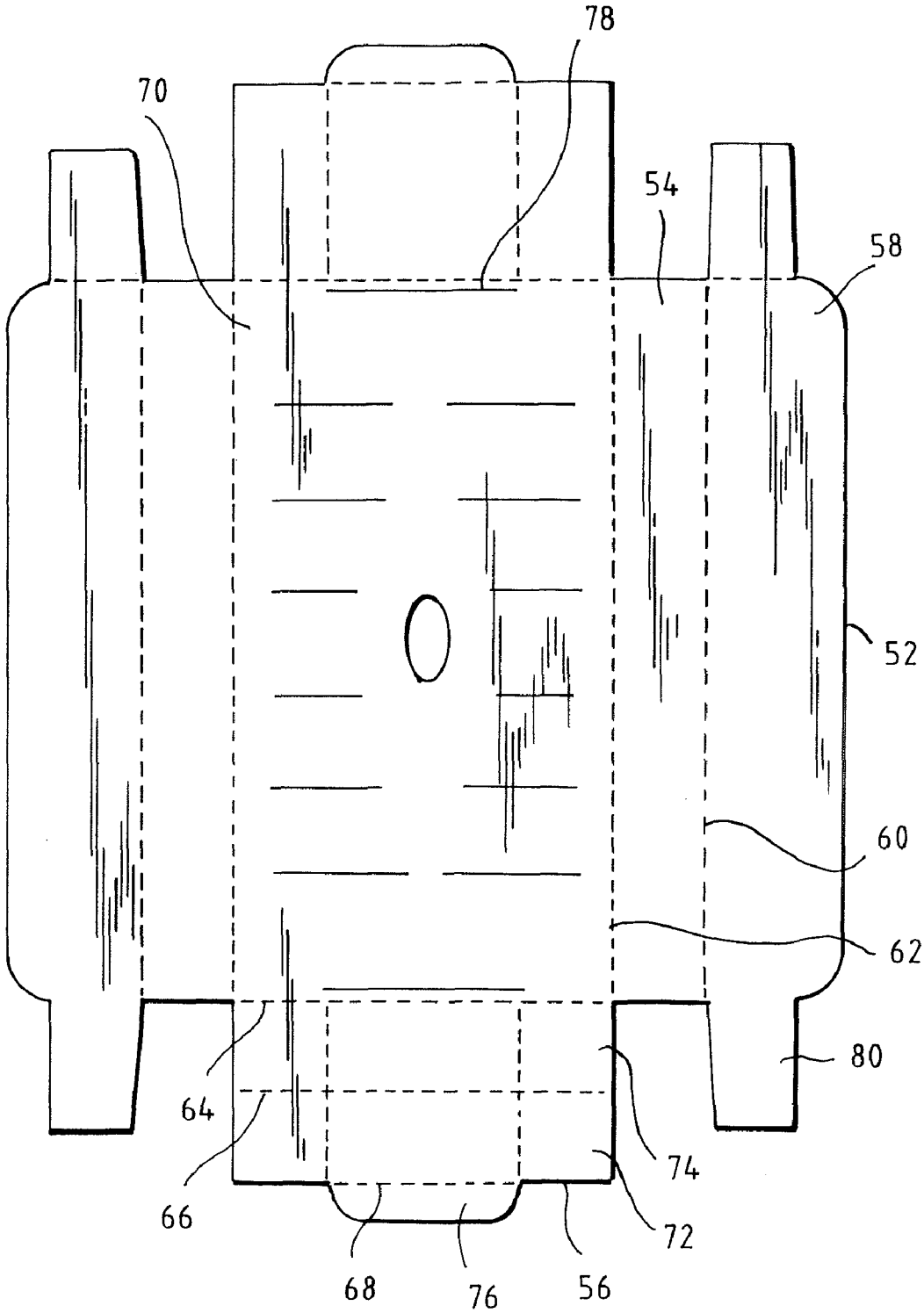
FIG. 5 is a plan view of a unitary blank for forming the tray of FIG. 1.

Preferably, though not necessarily, the cooking apparatus 10 is formed from a single unitary blank 50 of material, such as paperboard. Forming the cooking apparatus 10 from a single unitary blank 50 can eliminate the need for separately attaching any of the legs 14, 20, side walls 16, or end walls 18, to each other or to the product support surface 12, such as by using adhesive. The unitary blank 50 includes multiple panels connected via fold lines, such as weakened or scored lines, as illustrated in FIG. 5, suitable for facilitating folding of the blank 50 into the cooking apparatus 10. The panels include a center panel 70 for forming the food support surface 12, a pair of longitudinal side panels 52 for forming the longitudinal legs 14 and the side walls 16, and a pair of end panels 56 for forming the transverse legs 20 and the end walls 18.

As can be seen from the blank 50, the side walls 16 and the longitudinal legs 14 are formed from the same panel 52. The blank 50 includes a fold line 62 on the shared edge between the center panel 70 and the longitudinal panel 52. Another fold line 60 is formed on the longitudinal panel 52 to separate each longitudinal panel 52 into a first section 54 that will form the inner wall 42 of the longitudinal leg 14, and a second section 58 that will form the outer wall 40 of the leg 14 and the side wall 16. The longitudinal panel 52 is folded down 90 degrees along fold line 62, to a position perpendicular to the food support surface. The second section 58 of the panel 52 forming the outer wall 40 and side wall 16 is then folded outwardly and upwardly along fold line 60 and against the first section 54 to substantially mate with the outer facing side of the first section 54. By folding the second section 58 against the first section 54, the inner wall 42 and outer wall 40 of the depending longitudinal leg 14 are formed, with fold line 60 connecting the inner wall 42 and the outer wall 40 opposite the food support surface 12. Further, the second section 58 is higher than the first section 54, such that when the second section 58 is folded against the first section 54, a portion of the second section 58 extends above the food support surface 12 to thus form the side wall 16. Therefore, as illustrated in FIGS. 1 and 2, the side wall 16 is integral with the outer wall 40 portion of the longitudinal leg 14. Each of the longitudinal panels 52 are folded identically.

Similarly, as can be seen from the blank 50, the end walls 18 and the transverse legs 20 are also formed from the same panel 56. The blank 50 includes a fold line 64 on the shared edge between the center panel 70 and the end panel 56. Another fold line 66 is formed on the end panel 56 to separate the end panel 56 into a first section 74 that will form the inner wall 44 of the transverse leg 20 and a second section 72 that will form the outer wall 46 of the transverse leg 20. A third fold line 68 is formed between the second section 72 of the end panel 56 and an end tab section 76 of the end panel 56. The end tab section 76 will form the end wall 18 of the apparatus 10.

Before folding the end panels 56, an opposing pair of fold tabs 80 extending from the second section of the folded longitudinal panel are folded in under the food support surface 12 and perpendicular to the longitudinal legs 14 formed from the folding of the longitudinal panel 52. The end panel 56 is then folded down 90 degrees along fold line 64, and the second section 72 is folded upwardly and inwardly along fold line 66 and against the first section 74 of the end panel 56 and around the folded in fold tabs 80 to substantially mate with the inner facing side wall of the first section 74. By folding the second section 22 against the first section 74, the inner wall 44 and outer wall 46 of the depending transverse leg 20 are formed, with fold line 66 connecting the inner wall 44 and outer wall 46 opposite the food support surface 12, and with fold tabs 80 extending between a portion of the inner wall 44 and the outer wall 46. The fold line 64 also has a through slot 78 on or adjacent thereto. The end tab section 76 of the end panel 56 extending from the second section 72 (that, when folded, forms the inner wall 44 of the transverse leg 20) is inserted through the slot 78 such that it extends through the slot 78 and above the food support surface 12 to form the end wall 18. Thus, the end wall 18 is formed integral with the inner wall 44 of the transverse leg 20. Each of the end panels 56 are folded identically. The assembled cooking apparatus 10 is thus produced from the blank 50.

The susceptor 22 can be attached either when the cooking apparatus 10 has been formed or to the unitary blank 50 prior to its folding into the cooking apparatus 10, or at intermediate steps thereof. For example, the susceptor 22 can be attached to the center panel 70 of the unitary blank 50, which will become the product support surface 12, prior to folding into the raised cooking apparatus 10. However, it is preferable, though not necessary, that the optional vent 24 in the legs 14 and the aligned vents 26 and/or slits 36 in the product support surface 12 and susceptor 22 are formed prior to folding of the blank 50 into the raised cooking apparatus 10 and after the susceptor 22 has been attached to the blank 50. This will permit the simultaneous forming of the aligned vents and slits in the product support surface 12 and the susceptor 22.

Figure 6:
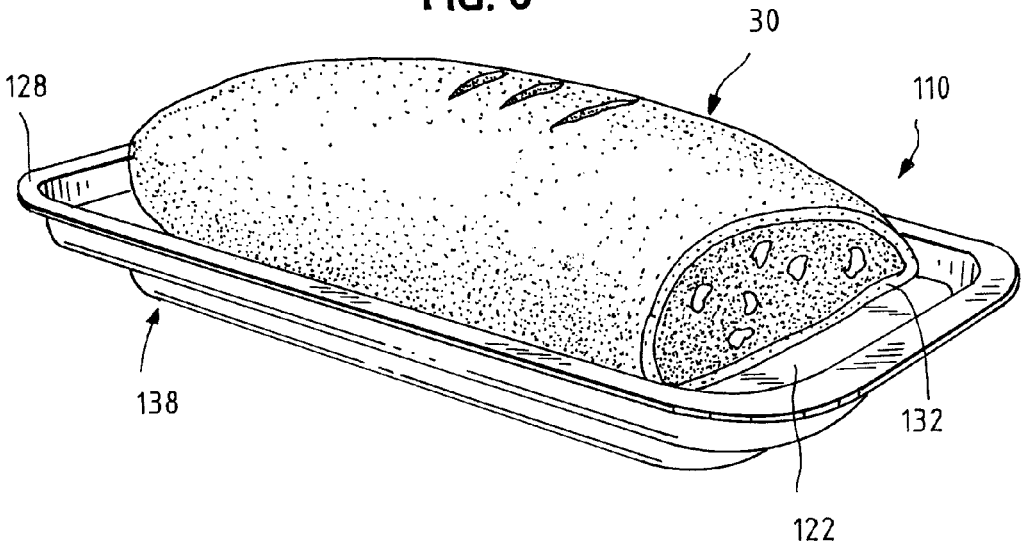
FIG. 6 is a perspective view of a second embodiment of a tray for microwave cooking of a food product, shown in combination with a food product on a food platform and susceptor.
Figure 7:
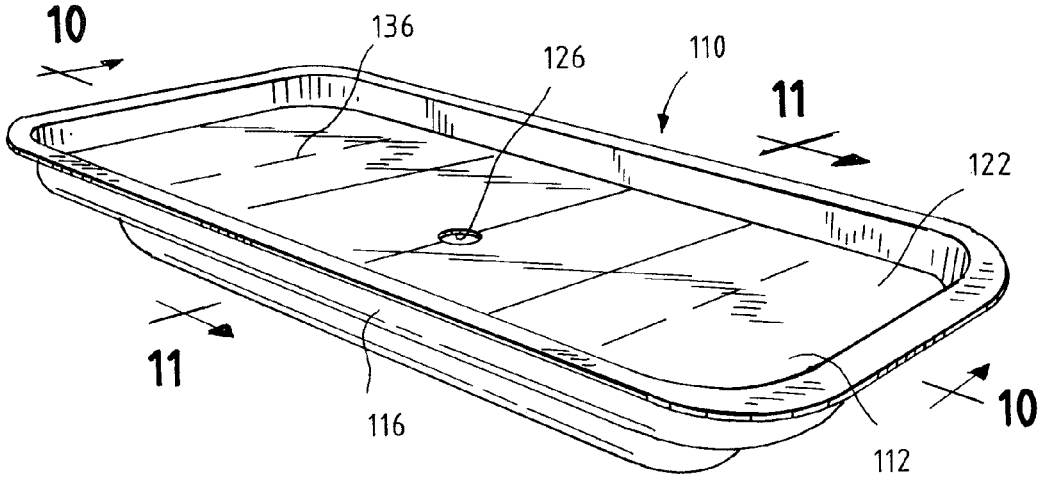
FIG. 7 is a perspective view of the tray of FIG. 6 shown without the food product.
Figure 8:
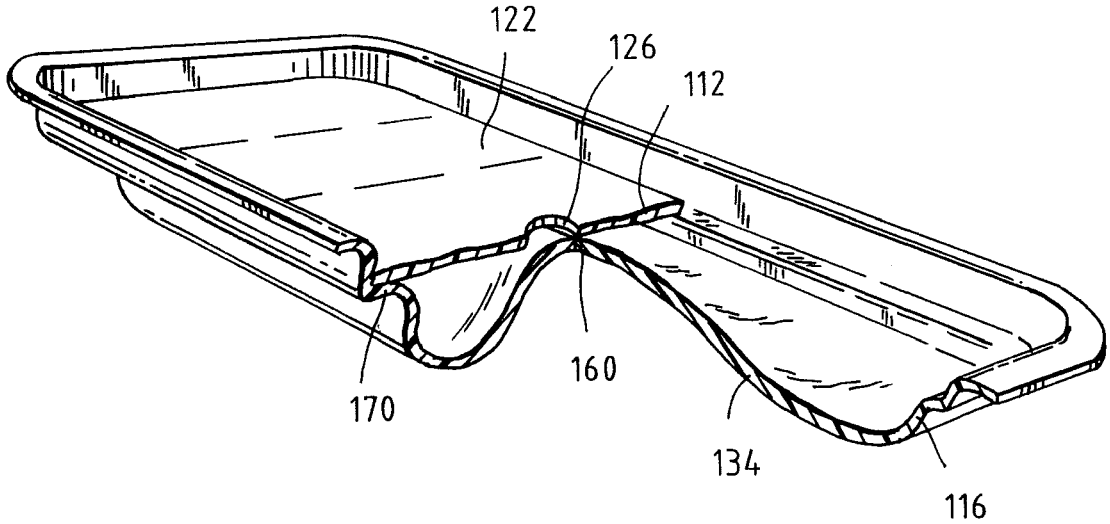
FIG. 8 is a perspective view of the tray of FIG. 7 with a portion of the tray broken away to show the interior thereof.
Figure 9:
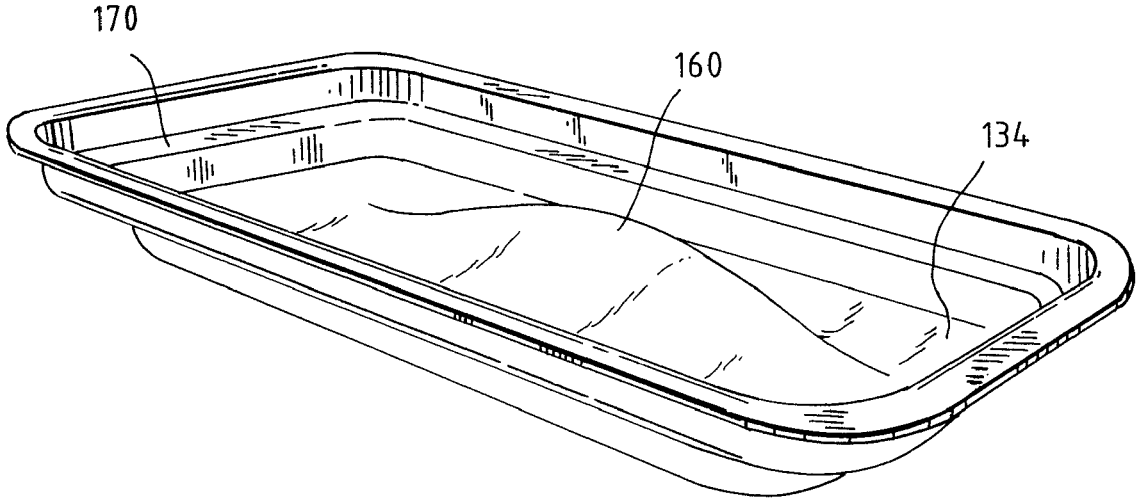
FIG. 9 is a perspective view of the tray of FIG. 7 shown with the food platform and susceptor removed.

A second embodiment of a cooking apparatus 110 is illustrated in FIGS. 6-13. The apparatus or tray 110 includes a tray portion 138 having a bottom wall 134 and an upstanding side wall 116. The side wall 116 preferably surrounds the periphery of the bottom wall 134. The cooking apparatus 110 further includes a food platform 112 having a susceptor 122 thereon for conducting heat to the food product 30 during microwave cooking. The susceptor is generally sized to accommodate the footprint of the food product 30, such that substantially all of the bottom surface of the food product 30 will contact the susceptor 122. The food platform 112 is disposed in the tray portion 138 and is spaced from the bottom wall 134 and positioned below a top edge 128 of the side wall. The food platform 122 supports a food product 30, such as shown in FIG. 6, with the dough portion 32 of the food product 30 contacting the susceptor surface 122 of the food platform 112, or any of a variety of other support features.

The food platform 112 is supported by a support integrally formed in the tray 138. In the illustrated embodiment, the integral support for the food platform 112 includes both a raised portion 160 of the bottom wall 134 and a peripheral ledge 170 of the side wall 116. The integral support may optionally comprise only one of the raised portion 160 or the peripheral ledge 170 to support the food platform 112.

As can be seen in FIGS. 8-11, the raised portion 160 of the tray 138 is generally centrally located on the bottom wall 134. As illustrated in the figures, the raised portion 160 is longer in the longitudinal direction of the tray 138, than in the lateral direction of the tray 138. In addition, the raised portion 160 is spaced from the upstanding side walls 116, such that a gap exists around the periphery of the raised portion 160. The gap between the raised portion 160 and the side walls 116 facilitates venting of moisture from the food product 30 during microwave cooking.

Similar to the first embodiment, the food platform 112 and the susceptor 122 may have at least one aligned vent aperture 126 formed therethrough for venting moisture from the food 30 during the microwave cooking. The illustrated embodiment includes one vent hole 126 that is generally aligned with the raised portion 160 of the bottom wall 134. In addition, a series of slits 136 are formed in the food support surface 112 and susceptor 122. The vent 126 and the slits 136 allow steam vapor exiting the food product 30 during the cooking cycle to enter the cavity below the food support surface 112, and circulate and collect under the food support surface 112, between the bottom wall 134 and side walls 116. Such a configuration can assist in reducing moisture that gathers on the surface of the food product 30, thereby reducing the possibility of a soggy food product 30. Thus, the gap area between the raised portion 160 and the side walls 116 allows for space for the moisture to vent and circulate. Holes may optionally be provided between the susceptor 122 and the bottom wall 134, or a gap between the susceptor 122 and the side wall 116 for venting.

Figure 10:
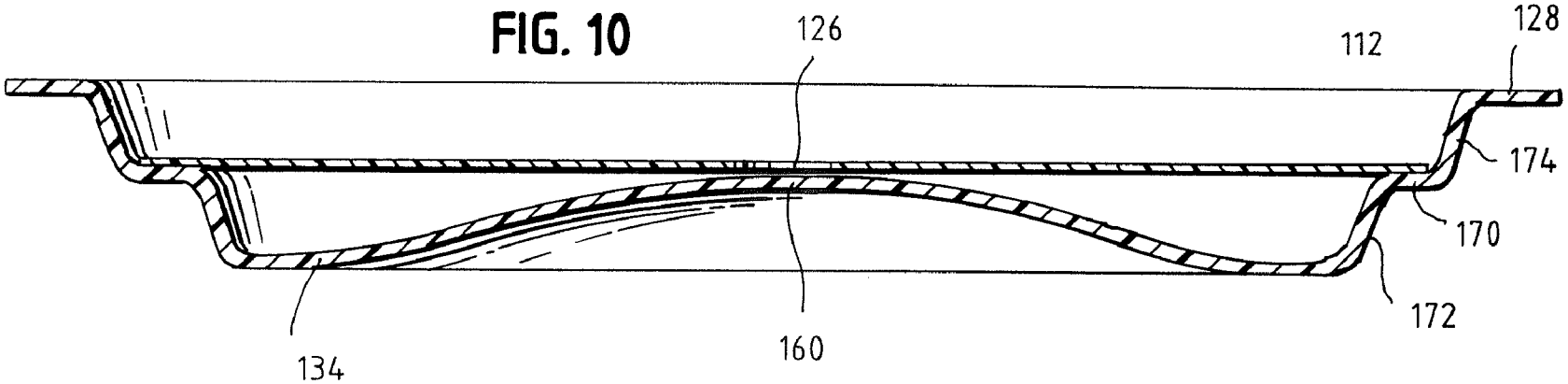
FIG. 10 is a cross-sectional elevation view of the tray of FIG. 7 taken along X-X thereof.
Figure 11:
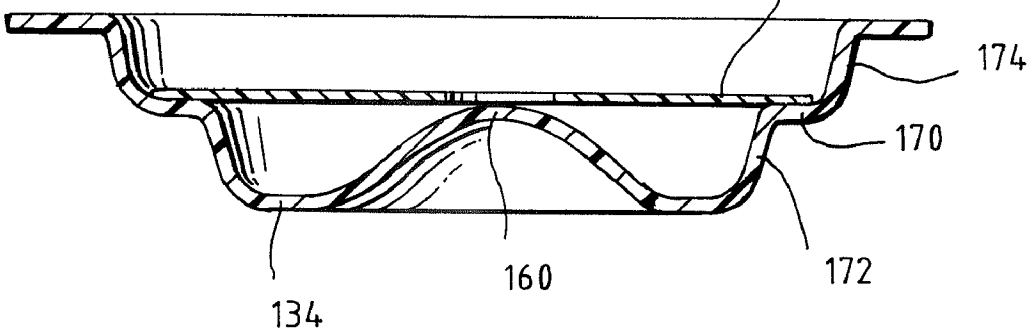
FIG. 11 is a cross-sectional elevation view of the tray of FIG. 7 taken along XI-XI thereof.
Figure 12:
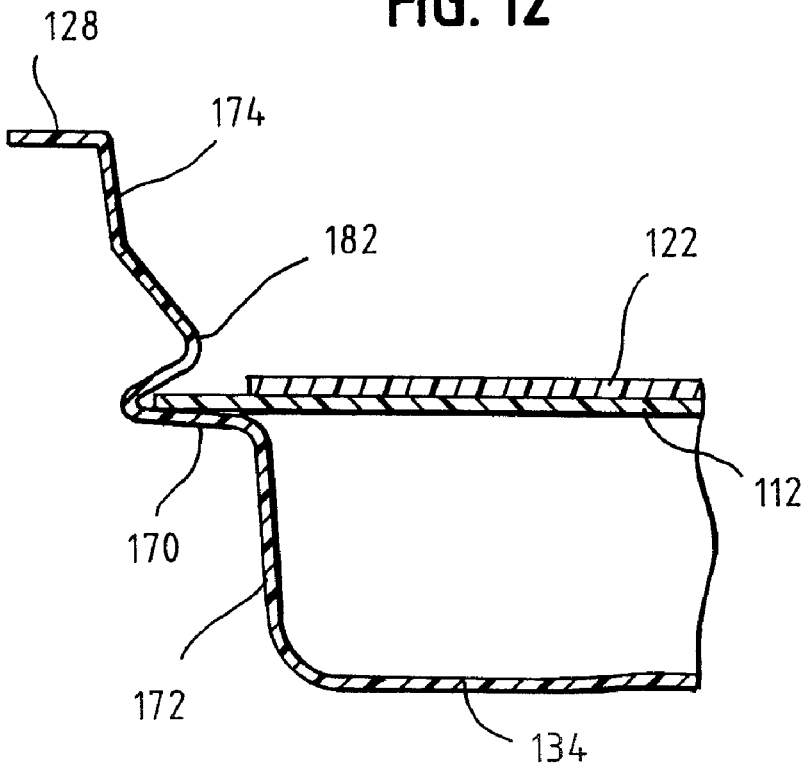
FIG. 12 is a profile view of a side wall of the tray of FIG. 7.
Figure 13:
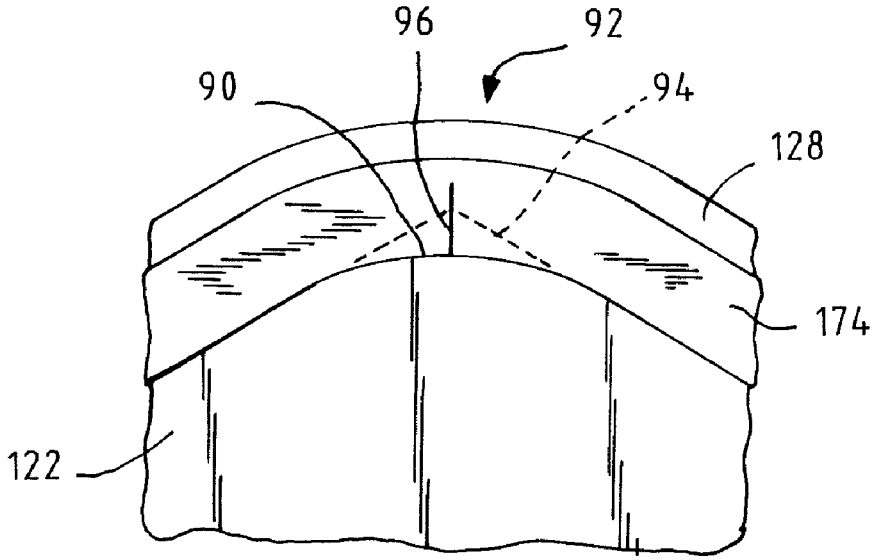
FIG. 13 is a perspective view of a corner of the tray of FIG. 7.

The food platform 112 is further supported by a peripheral ledge 170 of the side wall 116 that extends around the tray 138. As illustrated in FIGS. 10 and 11, the side wall 116 has a step-like feature that comprises the peripheral ledge 170. Thus, the side wall 116 includes an inner, lower wall portion 172 and an outer, upper wall portion 174, with the lower wall 172 and the upper wall 174 connected by the generally horizontal peripheral ledge 170. The food platform 112 may be secured on the peripheral ledge 170 by adhesive or a lock down feature. Illustrative examples of a lock down feature are shown in FIGS. 12 and 13. As illustrated in FIG. 12, a lug 182 may protrude from the upper wall 174 above the ledge 170. The food platform 112 is inserted under the lug 182, such that the lug 182 secures the food platform 112 in the tray 138 and holds the food platform 112 in place on the ledge 170. By another optional approach, as illustrated in FIG. 13, the rounded corners 92 of the tray 138 may have a corner slit 90 therethrough at the junction of the upper wall 174 and the ledge 170. The corner 92 may also optionally have a transverse slit 96 extending perpendicular to and extending from the corner slit 90. A food platform 112 having square corners 94 can then be disposed in the tray 138, with the corner 94 of the food platform 112 being inserted through the corner slit 90, such that the corner 94 of the food platform 112 is secured between the side wall 174 and the ledge 170. The transverse slit 96 can facilitate insertions of the food platform 112 into the corner slit 90. The susceptor 122 will thus be retained in the tray 138.

The peripheral ledge 170 is spaced from the bottom wall 134 of the tray 138 and is also positioned below a top edge 128 of the side wall 116. Thus, when the food platform 112 is disposed in the tray 138 on the peripheral ledge 170, the food platform 112 is recessed within the tray 138 such that the upper wall portion 174 of the side wall 116 extends above and around the food platform 112. The upper wall 174 will therefore assist in controlling the food product 30 and restricting shifting or movement of the food product 30 prior to removal from the cooking apparatus 110, such as before and after microwave cooking. Similar to the first embodiment, the tray 138 may be tilted to at least 45 degrees without the food product 30 falling off of the food platform 112, with the upper walls 174 maintaining the food product 30 in position on the tray 138. In addition, the upper wall 174 provides for spillage containment for any portion of the food product 30 that may escape the food product 30 during cooking. However, the upper wall 174 will not extend so high that a consumer will have difficulty accessing the food product 30 or retrieving the food product 30 from the tray 138. In addition, the top edge 128 of the side wall 116 that surrounds the perimeter of the side wall 116 forms a lip and extends away from the side wall 116 parallel to the food platform 112. Therefore, a consumer can grip the tray 138 by the top edge 128 to move or pick up the tray 138, which provides for cool handling.

The raised portion 160 of the bottom wall 134 extends upward to approximately the height of the peripheral ledge 170, such that the ledge 170 is approximately even with the apex of the raised portion 160 of the bottom wall 134. Thus, the food platform 112 is supported by both the raised portion 160 and the peripheral ledge 170, in a position elevated from the bottom wall 134. For example, the raised portion 160 and the peripheral ledge 170 may elevate the food support surface 112 between about 0.25 and 1.75 inches, and preferably about 1 inch, above the bottom wall of a microwave oven. As discussed above with respect to the first embodiment, the raised position of the food platform 112 allows for microwaves to reflect off of the side walls and bottom wall of the microwave and to be redirected to the underside of the food platform 112 to provide for heating of the bottom of the food product 30.

The support provided by both the raised portion 160 and the peripheral ledge 170 also offer increased rigidity and support for the food platform 112 such that the food product 30 can be adequately supported during cooking. The raised portion 160 also substantially limits any sagging or deformation at the center area of the food platform 112 due to the weight of the food product 30, thus facilitating maximum surface area contact between the food product 30 and the susceptor 122 on the food platform 112. The rigidity provided by the structure of the raised portion 160 and ledge 170 can allow a consumer to consume the food product directly from the tray 138. The food product 30 will remain supported by the raised portion 160 and ledge 170 post-cooking such that the food platform 112 can generally withstand a downward force exerted on the platform 112, such as, for example, by a consumer cutting or otherwise using utensils to consume the food product 30 while it is on the food platform 112, depending upon the materials used to construct the cooking apparatus 110.

The tray 138 is preferably made of a molded paperboard or a molded polymer. The paperboard or polymer can be molded or pressed into the desired shape by pressing or drawing the paperboard or polymer into a mold cavity having the appropriate shape. The molded paperboard or polymer does not require folding, thereby easing assembly. Once removed from the mold cavity, the susceptor is then disposed on the ledge 170 of the tray 116. The molded paperboard or polymer also facilitates safe handling of the tray 138 for a consumer due to the cooling properties of the material. Upon completion of the cooking of the food product 30 within the microwave, the tray 138 will be sufficiently cooled for a consumer to safely handle the tray 138 and remove from the microwave. In addition, the rounded corners and smooth shapes of the tray side walls offer increased rigidity while using less material.

Various types and forms of susceptors 22 or 122 can be utilized with the cooking apparatus 10 or 110. For example, the susceptor 22 or 122 may be a film having a layer of metal deposited thereon. Alternatively, the susceptor 22 or 122 may be printed upon the blank 50, thereby eliminating the need for separate attachment, such as with adhesives. In addition, the susceptor 22 or 122 may have different thicknesses to assist in concentrating heat energy at select portions of the food product. By graduating the amount of susceptor material or coating, over-heating of select portions of the food product can be avoided during cooking. Virtually any pattern of susceptor 22 or 122 can be employed. For example, the susceptor 22 or 122 can be coated or printed as a series of space-apart diagonal stripes or can comprise an array of dots or other shapes. Further, the susceptor surface 22 or 122 may be formed separately from the support surface 12 or platform 112 and attached thereto. Alternatively, the susceptor surfaces 22 or 122 may be integrally formed with portions of the support surface 12 or platform 122.

Optionally, the cooking apparatus 10 or 110 with the food product 30 thereon can be contained within an outer wrapper (not shown). If this is the case, then the outer wrapper can be removed from around the combined cooking apparatus 10 or 110 and food product 30 and inserted into a microwave for cooking. The cooking apparatus 10 or 110 and food product 30, all within the wrapper, may be placed within an outer carton. Alternatively, the food product 30 alone can be wrapped in a wrapper. If this is the case, then the food product 30 can be removed from the wrapper and then replaced on the susceptor 22 or 122 of the food support surface 12 or 112 of the tray 10 or 110 to prepare the food product 30 for microwave cooking.

Preferred embodiments of a cooking apparatus are illustrated herein as having a generally rectangular form. Other forms such as polygons, circles, ovals and other irregular rounded shapes may also be used for the susceptors, tray and lid. In addition, various features from any of the different embodiments specifically discussed herein can be combined with others of the different embodiments.

The components and methods disclosed herein are particularly suitable for use with food products having a dough-based outer component, such as the stromboli illustrated herein. Other examples of food products having dough-based components include calzones, pitas, pizzas, sandwiches, and other such food products having one or more dough surfaces. In one example, the food product may comprise a bread-based product having a specific dough formulation that has been found to advantageously have an extended shelf life under refrigeration or freezing and properties which result in the product becoming neither too soggy nor too dry during heating in a microwave oven when used in conjunction with the packaging system disclosed herein. The dough formulations in the present specification are generally expressed in baker's percentages, which are weight percentages based on the weight of flour used in a specific recipe (generally per 100 pounds of flour). For example, for 100 pounds of flour in a recipe, 57 percent water and 1.5 percent salt would mean the addition of 57 pounds of water and 1.5 pounds of salt, respectively, to 100 pounds of flour. Of course, such baker's percentages do not normally add up to 100 percent. Conventional percentages can be calculated from baker's percentages by normalizing to 100 percent.

Baking science involves a complicated process employing time, temperature, and relative humidity to produce various bread products. The time, temperature and relative humidity parameters are generally different for bread, rolls, pizza crusts, pastry, and cereal products, not only with regard to their appearance (crust color, size, etc.), but also with regard to the development, texture, and size. Some of the desirable changes caused by baking are protein denaturing, starch gelatinization, moisture migration, and veracity (cell development or grain). Many factors may be involved in preparing a baked product which is appealing in the eyes of the ultimate consumer. A manufacturer must also consider items such as shelf life and how a consumer will actually use a product. Consequently, it is desirable to have some quantitative measure by which one can determine whether a production line product meets specification. One such measure is water activity.

Water activity is a measure of the percent of water remaining in a baked product after it has been baked. Cracker products typically have a water activity in the range of about 0.35 to 0.50. Common baked goods, for example, bread, dinner rolls, and pizza crusts, typically have a water activity in the range of about 0.90 to 0.98. The fully baked or par-baked bread products of this invention preferably have water activities of about 0.9 to about 0.96. Such fully baked or par-baked bread products have satisfactory frozen storage characteristics as well as satisfactory texture and taste when heated in a microwave oven.

The water activity of the bread product is measured after it has come out of the oven and cooled to about 100° F. Moisture content of the baked bread product may be measured with an aw meter, or by weight difference between the bread product after cooling to about 100° F. and after further, more complete drying (i.e., using a desiccator or other suitable and reliable method). Generally, the moisture content of fully baked or par-baked bread product is about 30 to 38 percent, and preferably in the range of about 34 to about 38 percent.

Since yeast is included in the formulation of the stromboli bread dough, a fermentation step is included in the dough preparation. The fermentation step allows the yeast to produce carbon dioxide gas which stretches and mellows the gluten contained in the flour, and aids in producing good flavor and texture. Techniques such as the "sponge and dough" method (i.e., fermenting a portion of the dough and adding an aliquot of the fermented dough to bulk unfermented dough) or the "brew system" method (i.e., fermenting some yeast, flour, and the like in a liquid system and then adding as separate ingredient) could be used if desired. Punching down, if used, occurs after fermentation and proofing.

The bread products used in the present invention may be prepared using a dough containing a combination of gums (e.g., xanthan and guar) and additional ingredients (e.g., DATEM) in the dough formulation. This provides an improved bread product for use in this application. Although an enzyme as used in the dough formulations of U.S. Pat. Nos. 6,764,700 and 6,919,097 (both of which are incorporated by reference in their entireties) is not needed in the present application (and therefore is preferably not used), it can be included if desired. Additionally, dough formulations disclosed in U.S. patent application Ser. No. 11/531,592 entitled "PACKAGING SYSTEM FOR STORAGE AND MICROWAVE HEATING OF FOOD PRODUCTS"; U.S. patent application Ser. No. 11/531,585 entitled "PACKAGING METHOD FOR STORAGE AND MICROWAVE HEATING OF FOOD PRODUCTS"; U.S. patent application Ser. No. 11/531,578 entitled "MICROWAVABLE FOOD PRODUCTS"; and U.S. patent application Ser. No. 11/531,601 entitled "BAKED MICROWAVABLE FROZEN BREAD AND BAKERY PRODUCTS," all of which were filed on Sep. 13, 2006, all of which are owned by the same assignee as the present application, and all of which are hereby incorporated by reference in their entireties, can be used in the present invention. Thus, an especially preferred recipe (in baker's percentages) for the dough prepared according to a preferred embodiment of the invention is provided in the following table.

| Ingredient | Range (% flour basis) | Preferred Range (% flour basis) | Most Preferred (% flour basis) |
|---|---|---|---|
| Flour | 100 | 100 | 100 |
| Instant Dry Yeast | 0.5-5.0 | 2.5-3.5 | 3.0 |
| Sodium Stearoyl Lactylate | 0-0.5 | 0.1-0.2 | 0.12 |

-continued

| Ingredient | Range (% flour basis) | Preferred Range (% flour basis) | Most Preferred (% flour basis) |
|---|---|---|---|
| Salt | 0.5-3.0 | 0.75-1.75 | 1.25 |
| Sweetener (e.g., sugar) | 1.0-10.0 | 2.0-5.0 | 3.0 |
| Calcium Propionate | 0-0.5 | 0-0.5 | 0 |
| Oil/Fat | 1.0-15.0 | 3.0-8.0 | 5.0 |
| Water | 50.0-68.0 | 54.0-62.0 | 58.0 |
| Monoglycerides/ Diglycerides | 0-2.0 | 0-1.5 | 0 |
| Lecithin | 0-1.5 | 0.4-0.6 | 0 |
| Xanthan | 0.05-1.0 | 0.05-0.2 | 0.1 |
| Guar | 0.05-1.5 | 0.05-0.2 | 0.1 |
| Dough Conditioner (e.g., PZ-44) | 0.1-1.0 | 0.1-0.4 | 0.25 |
| Starch (e.g., modified potato starch) | 1.0-7.0 | 2.0-5.0 | 3.25 |
| Ascorbic Acid | 0.01-0.1 | 0.02-0.04 | 0.03 |
| Enzyme (e.g., Alpha Amylase) | 0-0.45 | 0-0.35 | 0 |
| Methylcellulose | 0-1.5 | 0-0.6 | 0 |
| Diacetyl Tartaric Acid Esters of Monoglycerides (DATEM) | 0.1-1.0 | 0.1-0.6 | 0.25 |
| Spices/Seasonings/Flavors | 0-2.0 | 0.1-1.0 | 0.5 |

Moreover, the dough formulations of U.S. Pat. Nos. 6,764,700 and 6,919,097 could be used in the present invention if modified to include the combination of gums (e.g., xanthan and guar) and additional ingredients (e.g., DATEM) as used in the present invention. In other embodiments, other ingredients may be substituted for those listed above. For example, calcium stearoyl lactylate might be used in place of, or with, the sodium stearoyl lactylate. The flour is preferably hard wheat bread flour made from hard spring or winter wheat. Suitable oils and/or fats include vegetable oils, shortening, hydrogenated fats or oil, and the like. Preferably the fat is a solid, hydrogenated or partially hydrogenated vegetable oil; for example, a hydrogenated or partially hydrogenated cottonseed, corn, soybean, sunflower, canola oil, or mixture thereof, and similar hydrogenated or partially hydrogenated vegetable oils and mixtures. The preferred vegetable oils are corn, canola, sunflower seed, cottonseed, and soybean oils, or mixtures thereof, with soybean oil being the most preferred; fat substitutes such as Olestra™ and Benefat™ can also be used in combinations with such oils or fats. The oil may have a butter flavoring agent added by the producer. Alternatively, a butter flavoring agent or other flavoring agent may be added to the recipe in an amount known to those, skilled in the art or in accordance with the flavor manufacturer's recommendations. Generally, the preferred sweetener is sucrose. If other types of sweeteners (e.g., natural, artificial, corn syrups, and the like) are used, the levels of such other sweeteners should be adjusted to provide the desired level of sweetness and, if necessary (i.e., if corn syrup is used), the level of water may be adjusted to account for water added with the sweetener. Although the preferred dough conditioner is PZ-44 (a blend of whey and L-cystine) from Foremost Farms, other conventional dough conditioners may be used (e.g., L-cysteine, glutathione, sodium bisulphite, and the like as well as mixtures thereof). Suitable starches for use in this invention include, for example, modified potato starch, pre-gelatinized wheat starch, modified tapioca starch, modified wheat starch, and the like as well as mixtures thereof. Other forms of yeast may be used so long as water content (if any) of the specific form of yeast is taken into account in the formulation.

The drawings and the foregoing descriptions are not intended to represent the only forms of the cooking apparatus in regard to the details of construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation.

We claim:

1. A cooking apparatus for use in microwave cooking of food, the cooking apparatus comprising:

a tray having a bottom wall and a side wall;

a food platform disposed in the tray, the food platform being spaced from the bottom wall and positioned below a top edge of the side wall;

a susceptor disposed on the food platform for conducting heat to the food thereon during microwave cooking;

a lower wall of the side wall that is upstanding from the bottom wall;

an upper wall of the side wall disposed above the lower wall and extending toward the top edge of the side wall;

an inner peripheral ledge of the side wall that connects the lower wall to the upper wall, the inner peripheral ledge extending substantially parallel to the bottom wall of the tray and supporting the food platform above the bottom wall of the tray; and a corner slit positioned adjacent the intersection of the upper wall and the inner peripheral ledge, the corner slit extending through the side wall and being sized to receive a corner of the food platform, the corner of the food platform being secured between the upper wall and the ledge with the corner of the food platform located within the corner slit.

2. A cooking apparatus in accordance with claim 1 wherein a secondary slit intersects the corner slit to facilitate insertion of the corner of the food platform into the corner slit.

3. A cooking apparatus in accordance with claim 1 wherein the upper wall of the side wall further comprises at least one lug projecting inwardly from the upper wall above the inner peripheral ledge, the at least one lug restricting removal of the food platform.

4. A cooking apparatus in accordance with claim 1 wherein the bottom wall of the tray has a raised portion.

5. A cooking apparatus in accordance with claim 1 wherein the susceptor and food platform have at least one aligned vent aperture formed therethrough for venting moisture from the food during microwave cooking.

6. A cooking apparatus in accordance with claim 5 wherein the bottom wall of the tray has a raised portion and one of the at least one aligned vent apertures is generally aligned with the raised portion of the bottom wall.

7. A cooking apparatus in accordance with claim 5 wherein the susceptor and the food platform have a plurality of aligned venting slits formed therethrough for venting moisture from the food during microwave cooking.

8. A cooking apparatus in accordance with claim 4 wherein the raised portion is centrally located on a geometric center of the bottom wall.

9. A cooking apparatus in accordance with claim 4 wherein the raised portion is spaced from the side wall to permit venting of moisture from the food during microwave cooking.

10. A cooking apparatus in accordance with claim 1 wherein the tray is made of one of a molded paperboard and a molded polymer.

11. A cooking apparatus in accordance with claim 3 wherein the upper wall of the side wall includes a plurality of lugs projecting inwardly above the inner peripheral ledge.

12. A cooking apparatus in accordance with claim 1 further comprising a food product.

13. A cooking apparatus in accordance with claim 1 wherein the food platform is removable from the tray.

* * * * *